US010618343B1

(12) United States Patent
Arminak

(10) Patent No.: US 10,618,343 B1
(45) Date of Patent: Apr. 14, 2020

(54) ONE-HAND OPERATED MULTI-PENCIL

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 0 days.

(21) Appl. No.: 16/430,010

(22) Filed: Jun. 3, 2019

Related U.S. Application Data

(60) Provisional application No. 62/792,629, filed on Jan. 15, 2019.

(51) Int. Cl.

| | |
|---|---|
| ***B43K 27/04*** | (2006.01) |
| ***B43K 21/16*** | (2006.01) |
| ***B43K 21/00*** | (2006.01) |
| ***B43K 21/06*** | (2006.01) |
| ***B43K 27/02*** | (2006.01) |
| ***B43K 27/00*** | (2006.01) |
| ***B43K 24/10*** | (2006.01) |
| ***B43K 24/12*** | (2006.01) |

(52) U.S. Cl.
CPC ..... *B43K 21/16* (2013.01); *B43K 21/006* (2013.01); *B43K 21/06* (2013.01); *B43K 24/10* (2013.01); *B43K 24/12* (2013.01); *B43K 27/006* (2013.01); *B43K 27/02* (2013.01); *B43K 27/04* (2013.01)

(58) Field of Classification Search
CPC ..... B43K 27/006; B43K 27/02; B43K 27/04; B43K 24/10; B43K 24/12; B43K 21/006; B43K 21/06; B43K 21/16
USPC ..... 401/31
See application file for complete search history.

(56) References Cited

U.S. PATENT DOCUMENTS

| | | | | |
|---|---|---|---|---|
| 6,217,241 | B1 | 4/2001 | Kobayashi | |
| 7,008,131 | B2 * | 3/2006 | Kagevarna | B43K 24/146 401/30 |
| 7,946,777 | B2 * | 5/2011 | Yamauchi | B43K 27/12 401/31 |
| 9,738,113 | B2 | 8/2017 | Tani | |
| 10,076,925 | B2 | 9/2018 | Tani | |
| 2008/0030486 | A1 | 2/2008 | Cook | |

(Continued)

FOREIGN PATENT DOCUMENTS

| | | | |
|---|---|---|---|
| GB | 805835 | A | 12/1958 |
| WO | 2010024346 | A1 | 3/2010 |

OTHER PUBLICATIONS

Patent Cooperation Treaty—International Searching Authority, PCT Notification of Transmittal of the International Search Report and the Written Opinion of the International Searching Authority, or the Declaration regarding Application No. PCT/US2019/047213 dated Nov. 1, 2019, 30 pages.

*Primary Examiner* — Jennifer C Chiang
(74) *Attorney, Agent, or Firm* — Cislo & Thomas, LLP

(57) ABSTRACT

A four color multi-pencil capable of one-handed operation is presented. Each color is contained in a cartridge assembly and each cartridge assembly may be individually selected for use and the material within the cartridge advanced for dispensing by means of a single pressing motion. The multi-pencil is designed to be a "snap together" assembly. No fasteners or adhesives are required. The multi-pencil contains a main body and a barrel. Housed within the barrel are a plurality of cartridge assemblies. Housed within the main body are a plurality of slide members for actuating the cartridges. Each cartridge assembly contains a mechanism for advancing drawing material or material to be dispensed, which is operated by simply depressing a cartridge selector.

19 Claims, 15 Drawing Sheets

(56) References Cited

U.S. PATENT DOCUMENTS

| | | | | |
|---|---|---|---|---|
| 2015/0313343 | A1* | 11/2015 | Weibl, Sr. ..... | B43K 27/08<br>401/30 |
| 2015/0343832 | A1 | 12/2015 | Tani | |
| 2017/0151824 | A1 | 6/2017 | Tani | |

* cited by examiner

ONE-HAND OPERATED MULTI-PENCIL

CROSS-REFERENCES TO RELATED APPLICATION

This application claims the benefit of U.S. Provisional Application Ser. No. 62/792,629, filed Jan. 15, 2019 and entitled "One-Hand Operated Multi-Pencil," which is incorporated here by this reference.

BACKGROUND OF THE INVENTION

Field of the Invention

This invention relates to multi-pencils and, in particular, to a one-hand operated multi-pencil for dispensing extrudable, cartridge contained drawing materials.

Background Art

Multi-pencils are popular among women for the application of eyeliner and eyeshadow. It is frequently desirable to apply eyeliner and eyeshadow in different and various colors. Individual eyeliner and eyeshadow pencils have been employed to this end in the past, but such practice has been awkward and inconvenient since it requires a multiplicity of duplicate implements of different colors. Several types of pencils provided with different color dispensing elements have been produced or proposed. These pencils have dispensing elements that can be selectively advanced and retracted from a dispensing position. While such prior art devices obviate the need for a plurality of different color pencils, they possess certain drawbacks. In particular, the cartridge advancing and dispensing mechanism typically requires a combination of a sliding and rotating motion which requires two hands to operate. Users therefore, find such devices awkward and generally difficult to operate.

There is a need in the art for an improved multi-pencil where the cartridge advancement and material extrusion may be accomplished with one hand, thereby greatly improving the usability of such devices.

SUMMARY OF THE INVENTION

The present invention meets a long-felt need in the art by providing a multi-pencil capable of one hand operation. The exemplary embodiment of the present invention multi-pencil is a four-color pencil. The principles disclosed can be used to create multi-pencils of both fewer and greater than four colors. Each color is contained in a cartridge and each cartridge may be individually selected for use and the material within the cartridge advanced for dispensing by means of a single pressing motion that may be accomplished with one hand. The multi-pencil is designed to be "snap together" assembly. No fasteners or adhesives are required to assemble the product.

The multi-pencil contains a main body and a barrel. Housed within the barrel are a plurality of cartridge assemblies. Housed within the main body are a plurality of slide members or cartridge selectors. Each cartridge assembly contains a mechanism for advancing drawing material or material to be dispensed, which is operated by simply depressing a cartridge (i.e. color) selector. This feature allows for one-hand operation of the multi-pencil and thereby improves upon prior art designs which require that both a color selector be depressed and the main body rotated relative to the barrel to advance the drawing material.

The above and other advantages of the all plastic hand pump of the present invention will be described in more detail below.

DETAILED DESCRIPTION OF THE PREFERRED EMBODIMENTS

Figure 1:
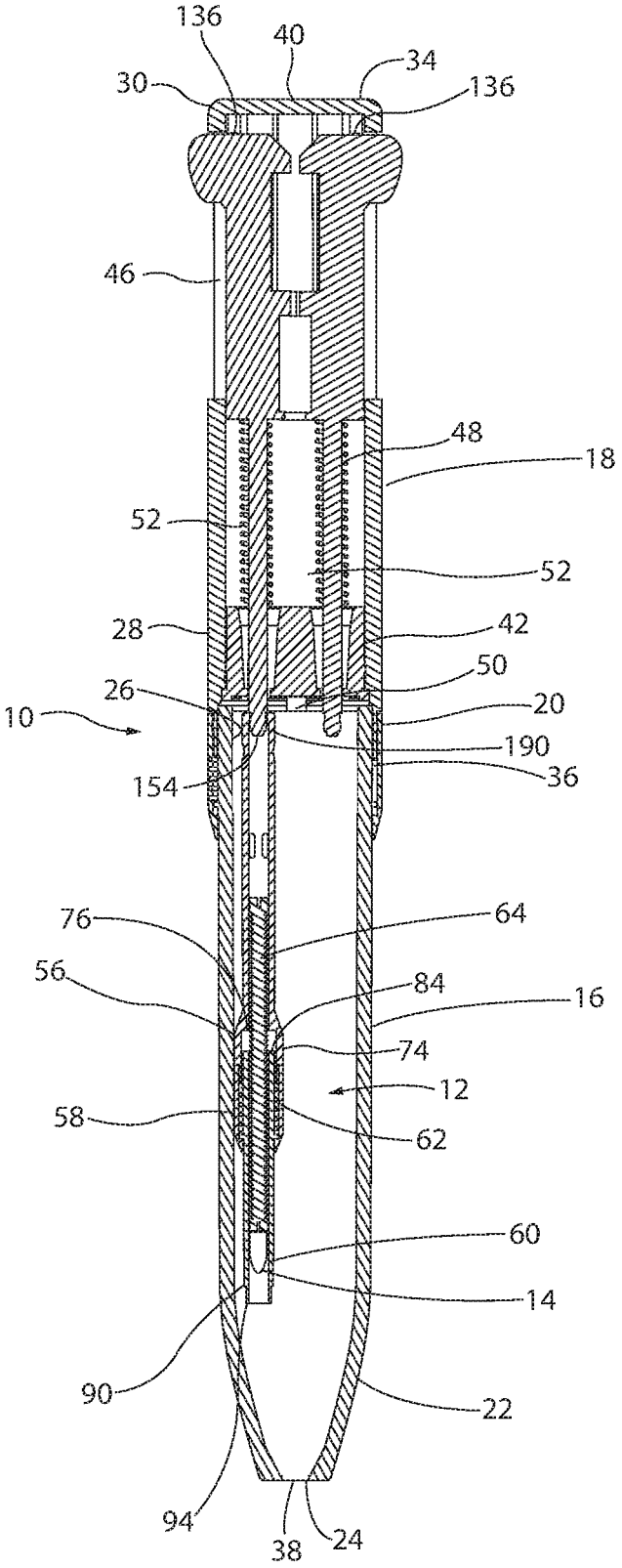
FIG. 1 is a side view illustrating a multi-pencil in accordance with the present invention, in an at-rest position, with only one selector and cartridge assembly shown for clarity.

The present invention will now be described more fully hereinafter with reference to the accompanying drawings, in which preferred embodiments of the invention are shown. The invention however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Description of the Component Parts

The exemplary embodiment of the present invention multi-pencil 10 is a four-color pencil. The principles disclosed can be used to create multi-pencils of both fewer and greater than four colors. Each color is contained in a cartridge assembly 12 and each cartridge assembly may be individually selected for use and the drawing material 14 within the cartridge assembly advanced for dispensing by means of a single pressing motion that may be accomplished with one hand.

With reference to FIGS. 1-26, the major components of the present invention multi-pencil 10 include a barrel or leading body 16, a main body 18, and a mid-body 20 which interconnects the barrel 16 and main body 18. The barrel 16 has a generally cylindrical upper portion and has a tapered lower portion or leading portion 22 terminating in an exit aperture 24. The barrel has an open upper end 26. The main body 18 is generally cylindrical and has a lower cylindrical portion 28 with an open lower end 32 (see FIG. 10) and a slotted upper portion 30 with a closed upper end 34.

The barrel 16 and the main body 18 are interconnected by means of a generally cylindrical mid-body 20. Disposed within the mid-body 20 is a main body biasing spring 36, which biases the main body 18 away from the barrel 16 in an axial direction. In the following description, an "axial line" means a center line which extends from a center 38 of the exit aperture 24 of the barrel 16 to a center 40 of the upper end 34 of the main body 18. An "axial direction" means a direction along the axial line in an upward or downward direction, where "downward" corresponds to a direction from the center 40 of the upper end 34 of the main body 18 towards the exit aperture 24 of the barrel 16 and "upward" corresponds to a direction from the exit aperture 24 towards the center 40 of the upper end 34 of the main body 18.

Disposed within the lower cylindrical portion 28 of the main body 18 is a guide plug 42. Also disposed within the main body 18 are four slide members or cartridge selectors 46, wherein each slide member 46 is biased upwardly by a slide member return spring 52, supported by the guide plug 42. Each slide member 46 includes an operating rod 48 which is guided by and slides through a guide hole 50 in the guide plug 42. The guide plug 42 serves to uniformly space the slide members 46 about the inside periphery of the main body 18.

Each operating rod 48 has a ball end 154 which includes a plurality of flexible fingers 202. The ball end 154 and flexible fingers 202 of the operating rod 48 engage an aperture or socket 204 at an end 190 of a movable sleeve 56 of the cartridge assembly 12. This form of engagement allows angulation of the cartridge assembly 12 at the connection with the operating rod 48 of the slide member 46. (See FIGS. 2-4.) Angulation of the cartridge assembly 12 allows a forward end of the cartridge assembly 12 deflect radially inwardly as it slides downwardly along the leading portion 22 of the barrel 16 and to extend from the aperture 24 of the barrel 16, when the slide member 46 associated with a particular cartridge assembly is actuated to deploy the cartridge assembly for use.

Each cartridge assembly 12 comprises a movable sleeve 56, a spring retainer 58, a material holder 60, a material holder biasing spring 62, an serrated shaft 64, and the drawing material or material to be dispensed 14. The movable sleeve 56 has a hollow cylindrical upper portion 70 and a hollow cylindrical lower portion 74. The hollow cylindrical upper portion 70 has an inside diameter 78 configured to be a slip-fit with an outside diameter 80 of the serrated shaft 64. The hollow cylindrical lower portion 74 has an inside diameter 82 which is equipped with a first serrated shaft engagement feature 76 (best shown in FIG. 19), which may be teeth, nubs or the like, and further includes a spring abutment surface 68. The serrated shaft engagement feature 76 of the movable sleeve 56 is configured such that the serrated shaft 64 may only advance axially downwardly through the serrated shaft engagement feature 76 and cannot move axially upwardly through the feature.

The spring retainer 58 is a hollow cylindrical element, attachable, via a press fit in the exemplary embodiment, to the movable sleeve 56. The spring retainer 58 serves to retain a material holder biasing spring 62. The material holder 60 is a hollow cylindrical body having an inside diameter 88 (see FIG. 22) configured to be a slip fit with the outside diameter 80 of the serrated shaft 64. The material holder includes a serrated shaft engagement feature 84 (teeth, nubs or the like) formed at a second or upper end 86 (see FIGS. 21-22). Like the serrated shaft engagement feature 76 of the movable sleeve, the serrated shaft engagement feature 84 of the material holder 60 is configured such that the serrated shaft 64 may only advance axially downwardly through the feature and cannot move axially upwardly through the feature.

Figure 21:
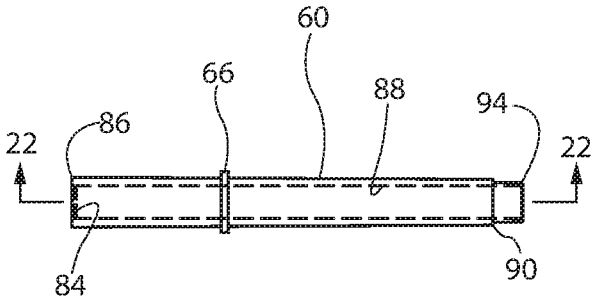
FIG. 21 is top view of the material holder of the multi-pencil of the present invention.
Figure 22:
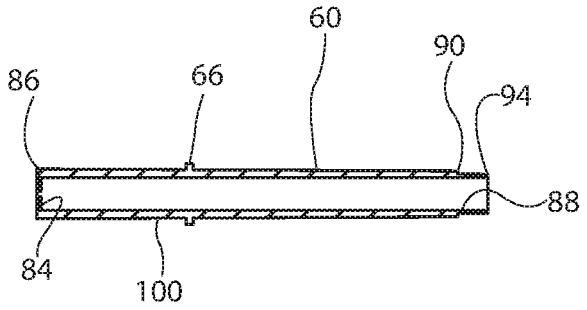
FIG. 22 is a side sectional view taken along the line 22-22 of FIG. 21 of the material holder of the multi-pencil of the present invention.
Figure 23:
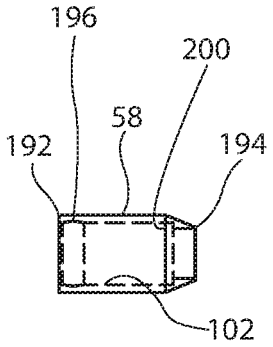
FIG. 23 is side view of the cartridge assembly spring retainer of the multi-pencil of the present invention.
Figure 24:
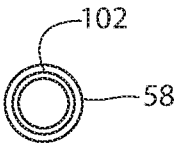
FIG. 24 is a bottom view of the cartridge assembly spring retainer of the multi-pencil of the present invention.
Figure 25:
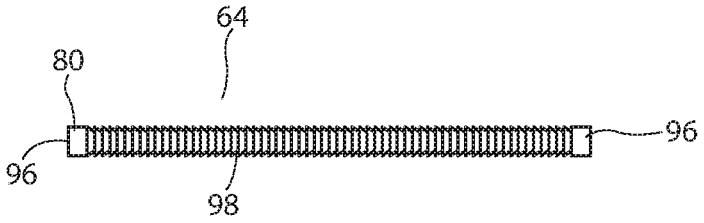
FIG. 25 is side view of the serrated shaft of the multi-pencil of the present invention.
Figure 26:
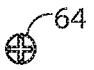
FIG. 26 is a right end view of the serrated shaft of the multi-pencil of the present invention.

The material holder also includes a lip 66 for engaging the material holder biasing spring 62 and a stop surface 90 (best shown in FIGS. 21-22). The stop surface 90 engages the leading surface 22 of the barrel at the coaxial aperture 24, during a downward stroke of the slide member 46 and cartridge assembly 12 and thereby limits the maximum extension of the material holder 60 from the leading edge 22 of the barrel 16. The material holder 60 further includes an open front end or second end 94, wherein the drawing material 14 is extruded from the open front end 94 of the material holder 60.

The serrated shaft 64 includes a plurality of teeth or threads 98 which are configured to engage the serrated shaft engagement feature 76 of the movable sleeve and the serrated shaft engagement feature 84 of the material holder. The serrated shaft 64 also includes an abutment surface 96 which presses on the drawing material 14. The drawing material 14 is typically a semi-rigid or rigid material that is consumed as it is applied. Therefore, the drawing material 14 must be advanced within material holder 60 such that a sufficient quantity of drawing material 14 extends from the open front end 94 of the material holder 60 when the cartridge assembly 12 containing the material holder 60 has been selected for use and therefore protrudes from the exit aperture 24 of the barrel 16.

Disposed within the movable sleeve 56 and the spring retainer 58 is the material holder 60. The movable sleeve 56, spring retainer 58 and material holder 60 are configured such that a material holder biasing spring 62 is disposed about an outside diameter 100 of the material holder 60 and inside an inside diameter 102 (see FIGS. 23-24) of the spring retainer 58, such that the material holder biasing spring 62 engages the annular lip 66 of the material holder 60 and abuts the abutment surface 68 of the movable sleeve 56.

Operation of the Cartridge Assembly

With reference to FIGS. 1-4, the operation of the cartridge assembly 12 to cause the drawing material 14 to be extruded from the cartridge assembly 12 is as follows. With reference to FIG. 1, the cartridge assembly 12 is shown at rest within the barrel 16.

Figure 2:
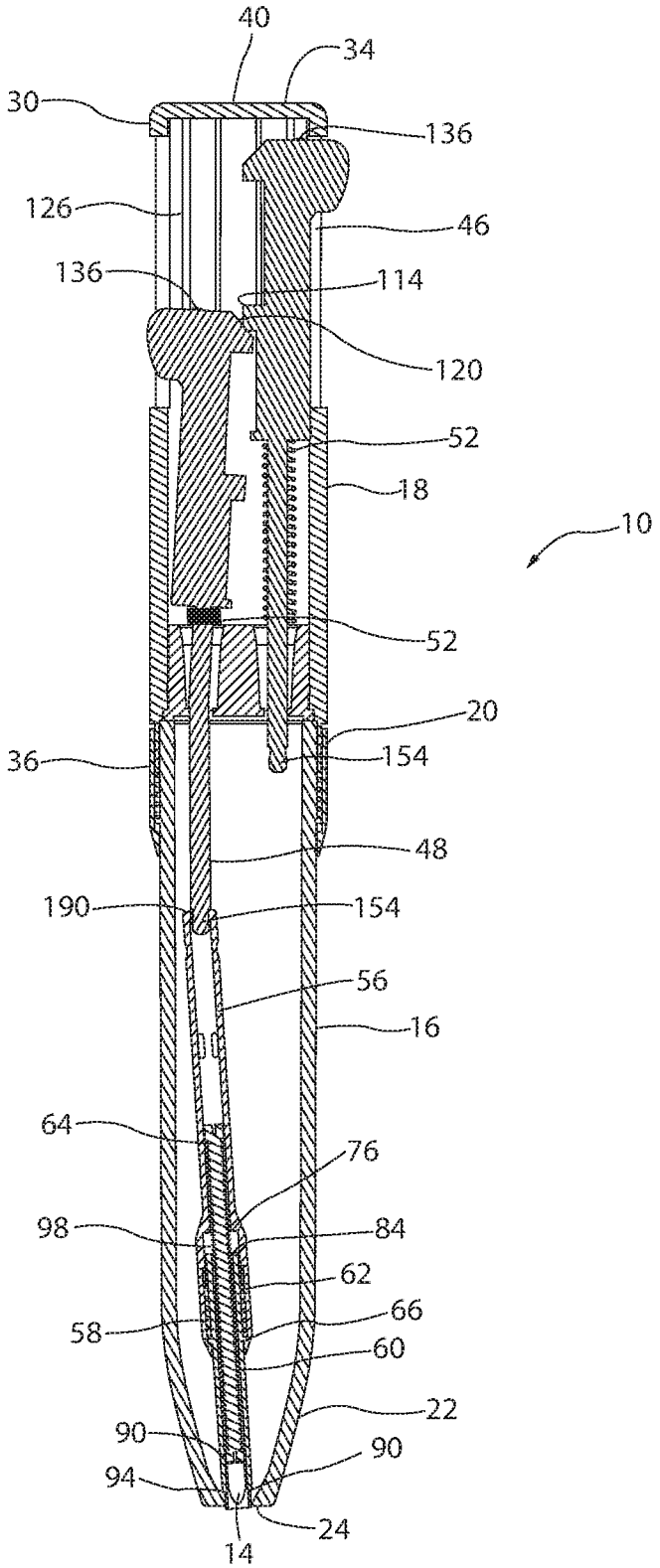
FIG. 2 is another side view of the multi-pencil of the present invention, shown with a cartridge selector in a depressed position, with only one selector and cartridge assembly shown for clarity.
Figure 3:
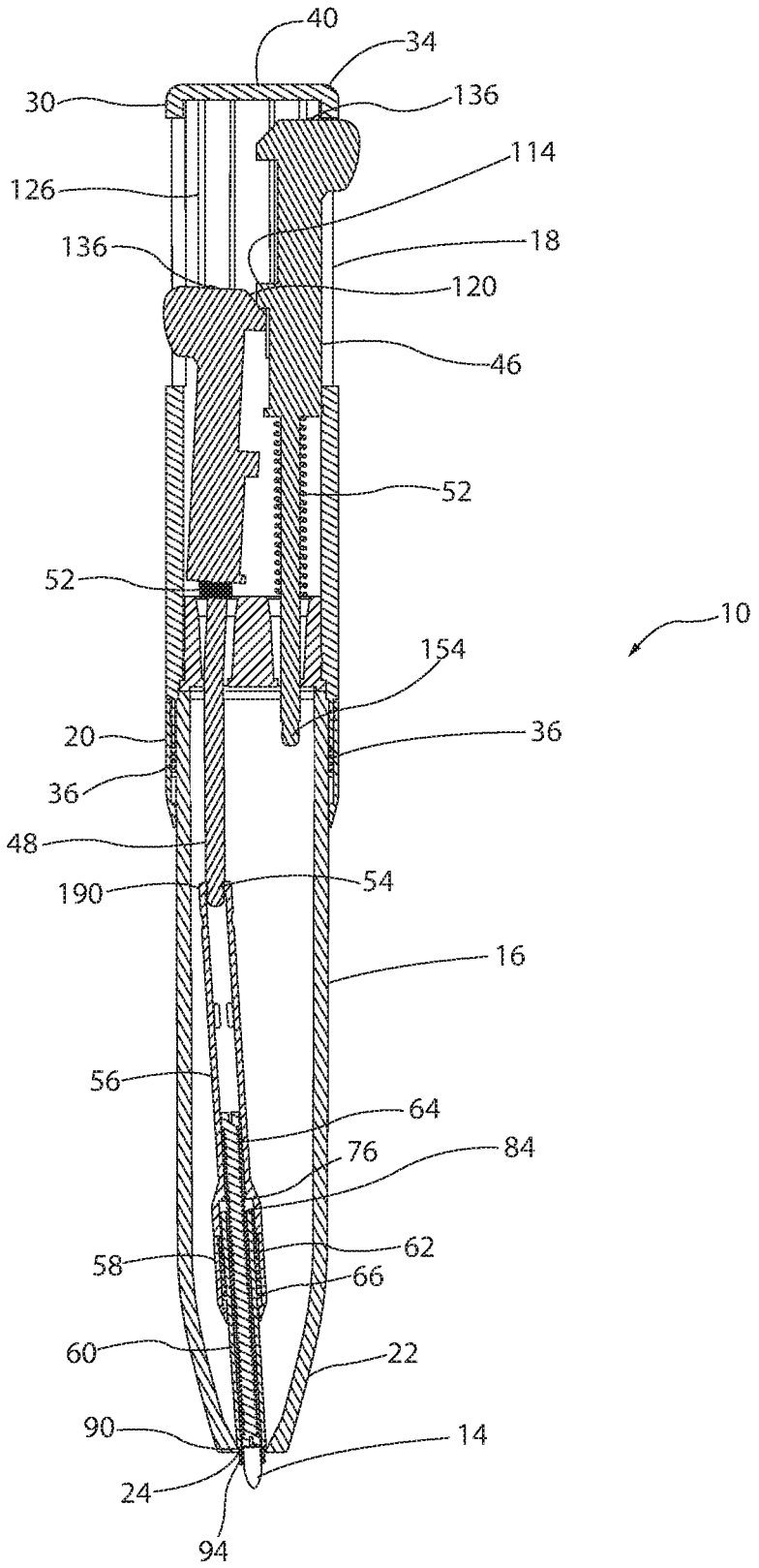
FIG. 3 is another side view of the multi-pencil of the present invention, shown with a cartridge selector depressed and a main body of the multi-pencil depressed relative to a barrel of the multi-pencil, with only one selector and cartridge assembly shown for clarity.
Figure 4:
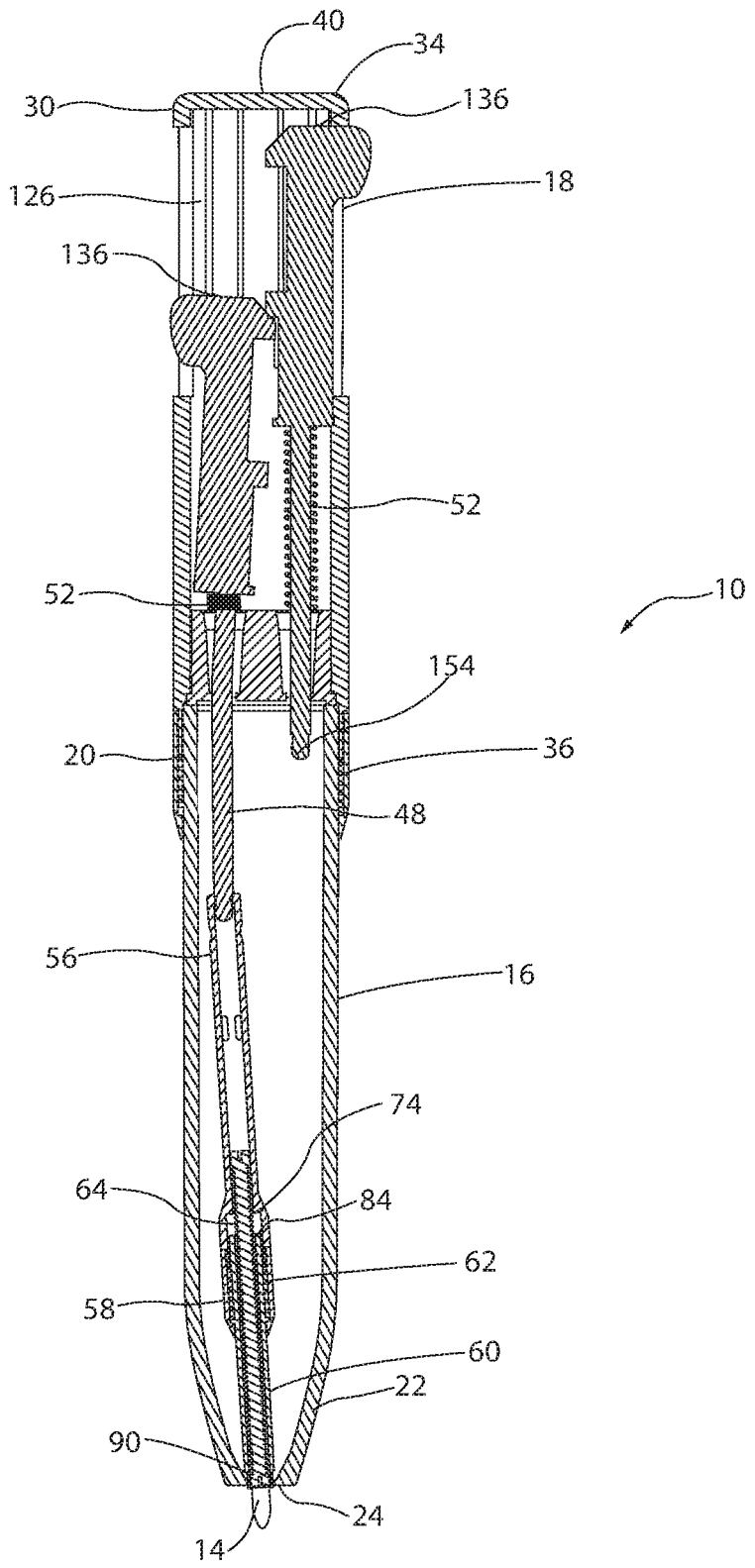
FIG. 4 is another side view of the multi-pencil of the present invention, shown with a cartridge selector depressed and with the main body of in an at-rest position relative to the barrel, with only one selector and cartridge assembly shown for clarity.

With reference to FIG. 2, a user depresses the slide member 46 which causes the slide member 46 to move axially downwardly until catches 136 of the slide member 46 engage end points 152 of lower ledges 126 of the main body 18 (see FIGS. 2-4). The catches 136 hold the slide member 46 in place until released by a user. With the slide member 46 depressed and latched, the operating rod 48 of the slide member 46 which is engaged with an open upper end 190 of the movable sleeve 56, causes the movable sleeve 56 and thus the cartridge assembly 12 to move axially downwardly within the barrel 16. Axial downward movement continues until the annular stop surface 90 of the material holder 60 engages the exit aperture 24 of the barrel 16, at which point further downward movement of the material holder 60 is prevented. At this point the open front end 94 of the material holder 60 extends from the exit aperture 24 of the barrel 16.

With reference to FIG. 3, a user holds the barrel 16 and presses axially downwardly on the main body 18. The amount of downward movement of the main body 18 relative to the barrel 16 is controlled by the compression height of the main body biasing spring 36. The application of force to cause axially downward movement on the main body 18 also causes the slide member 46 to move axially downwardly due to its being locked in place to the main body 18.

Axial downward movement of the locked-in-place slide member 46 causes the movable sleeve 56, via the operating rod 48, to move downwardly about the material holder 60. The serrated shaft engagement feature 76 of the moveable sleeve 56 allows only one-way travel of the serrated shaft 64. That is, the movable sleeve 56 prevents the serrated shaft 64 from moving axially upwardly into the movable sleeve 56 and, instead, pushes the serrated shaft axially downwardly through the serrated shaft engagement feature 84 of the material holder 60. The axially downward movement of the serrated shaft 64 causes the filling material 14 to be pushed from the material holder 60, out of the exit aperture 24.

With reference to FIG. 4, after a user has depressed the main body 18 relative to the barrel 16, when the user releases the main body 18, the main body biasing spring 36 drives the main body 18 upwardly. At the same time, the material holder biasing spring 62 drives the movable sleeve 56 upwardly relative to the material holder 60. During this upwards movement, the movable sleeve 56 moves up the serrated shaft 64 since the serrated shaft engagement feature 74 of the movable sleeve 56 allows movement in the upwards direction (but not in the downwards direction) and because the serrated shaft engagement feature 84 of the material holder 60 holds the serrated shaft 64 in place, i.e. it does not allow the serrated shaft 64 to move during upwards movement of the movable sleeve 56. The combined action of the upwards movement of the movable sleeve 56 and of the serrated shaft engagement features 74 and 84, respectively, has the effect of advancing the serrated shaft 64, downwardly, in the movable sleeve 56.

Description and Operation of the Slide Member Latch Features

Figure 5:
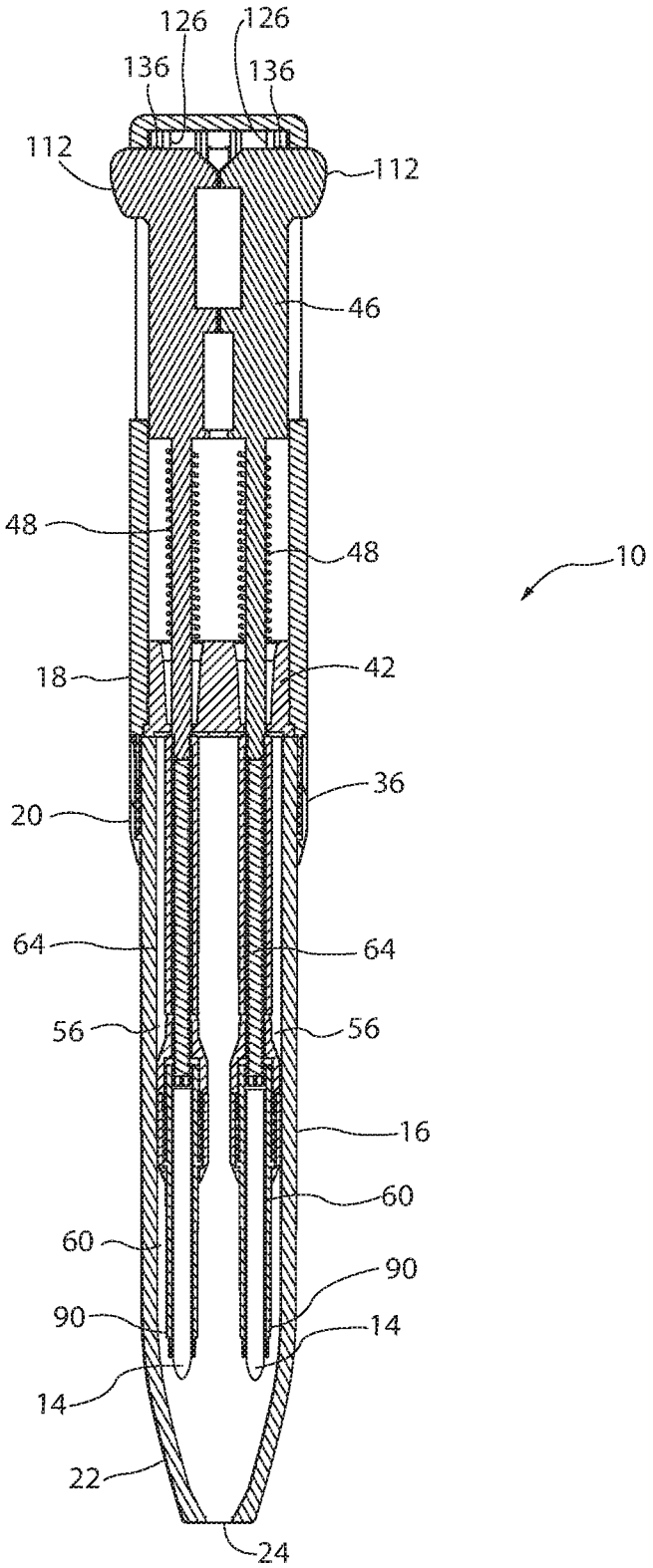
FIG. 5 is a side sectional view illustrating the multi-pencil of the present invention, in an at-rest position.
Figure 6:
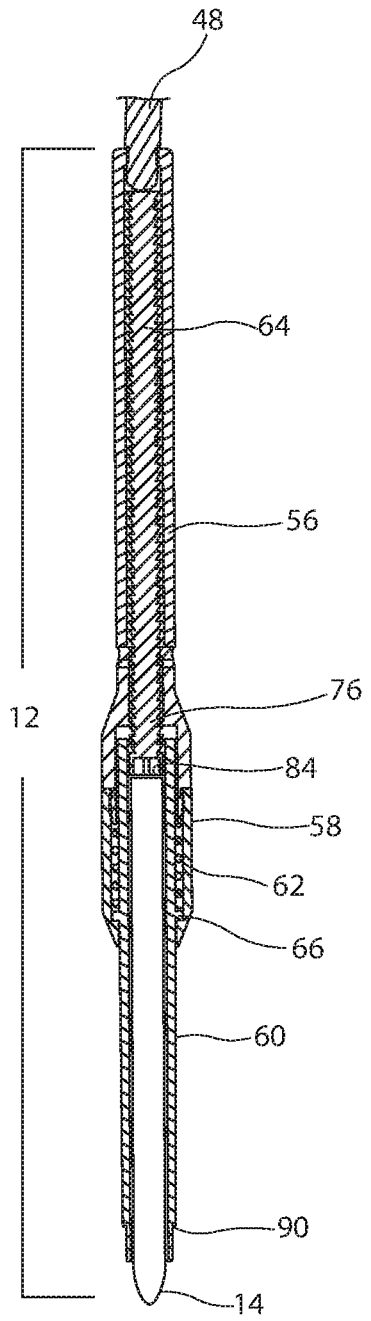
FIG. 6 is a side sectional view illustrating a cartridge assembly of the multi-pencil of the present invention.

With reference to FIG. 5, a cross-sectional view of the multi-pencil 10 of the present invention is shown with the slide members 46 and cartridge assemblies 12 retracted. Only two slide members 46 and cartridge assemblies 12 are shown for clarity.

Figure 7:
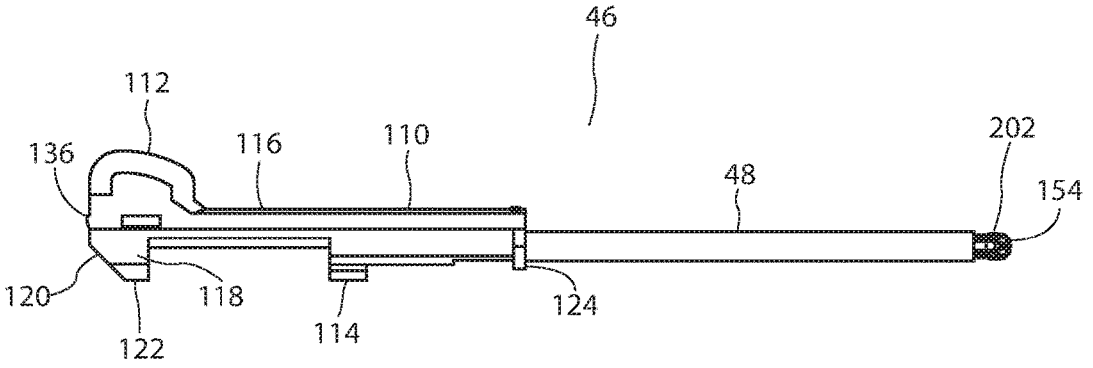
FIG. 7 is a side view of the cartridge selector or slide member of the multi-pencil of the present invention.
Figure 8:
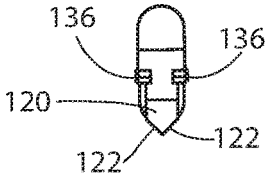
FIG. 8 is a left end view of the cartridge selector or slide member of the multi-pencil of the present invention.
Figure 9:
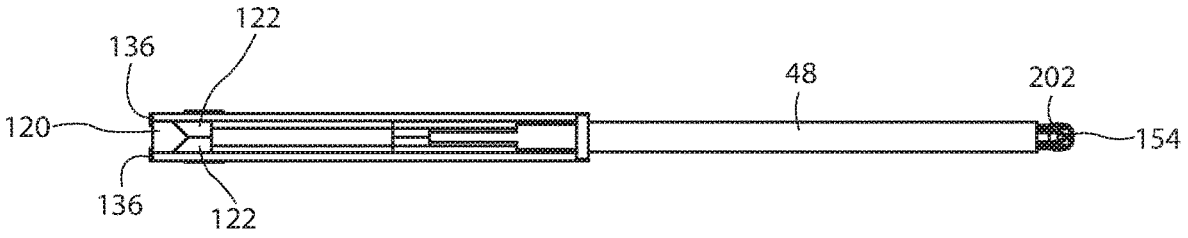
FIG. 9 is a bottom view of the cartridge selector or slide member of the multi-pencil of the present invention.

Referring now to FIGS. 7-9, the slide member 46 is shown in more detail. The slide member 46 includes an upper portion 110 and the operating rod 48. The upper portion 110 includes a finger tab 112, a striker 114, guides 116, catches 136, a spring abutment surface 124, and a disengagement member 118. The disengagement member 118 features a rear angled surface 120 and two mutually opposed side, angled surfaces 122.

Figure 10:
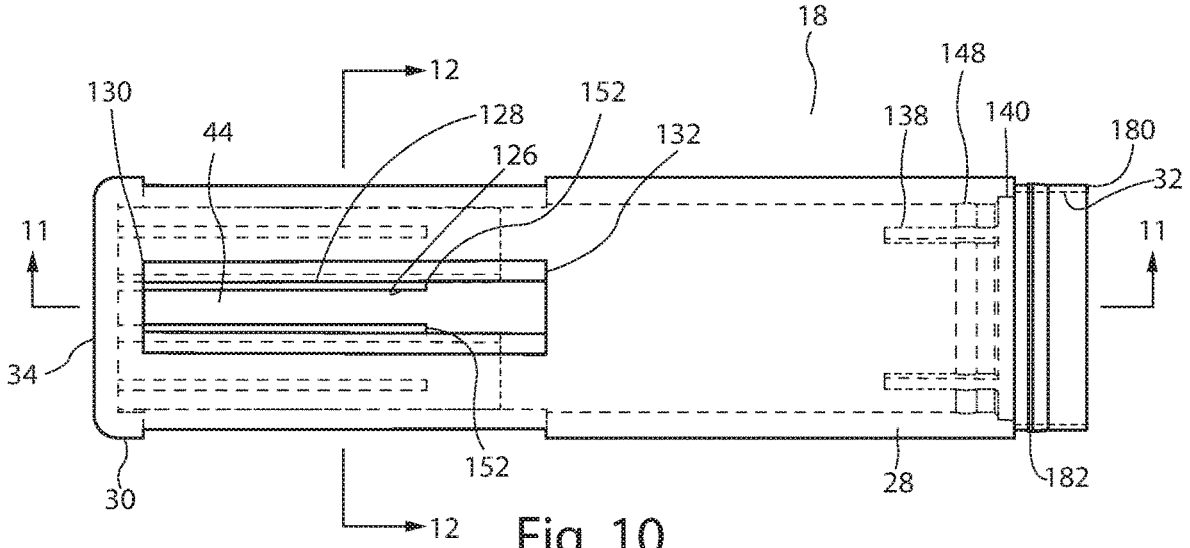
FIG. 10 is a side view of the main body of the multi-pencil of the present invention.
Figure 11:
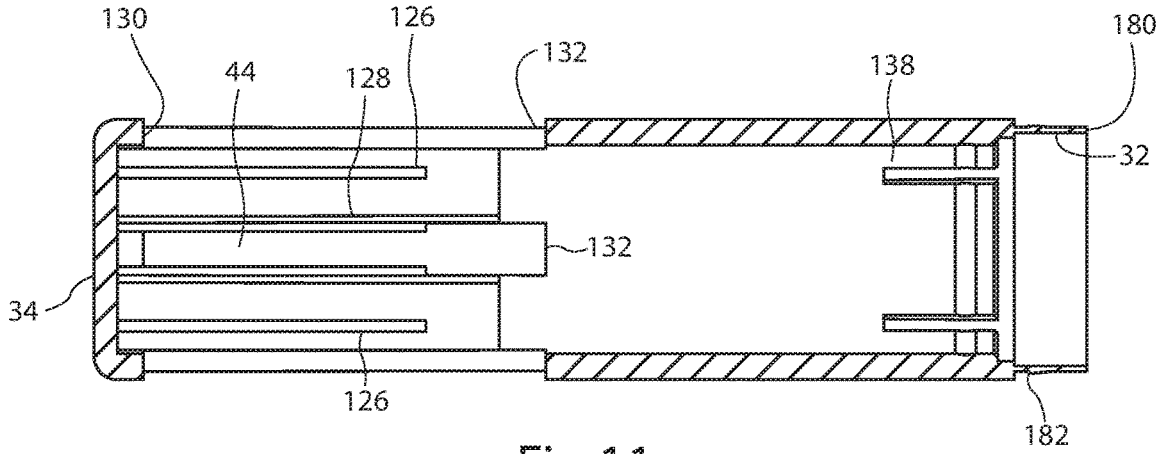
FIG. 11 is sectional view along the 11-11 of FIG. 10 of the main body of the multi-pencil of the present invention.
Figure 12:
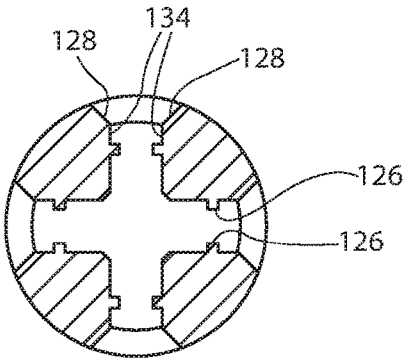
FIG. 12 is a left end view of the main body of the multi-pencil of the present invention.
Figure 13:
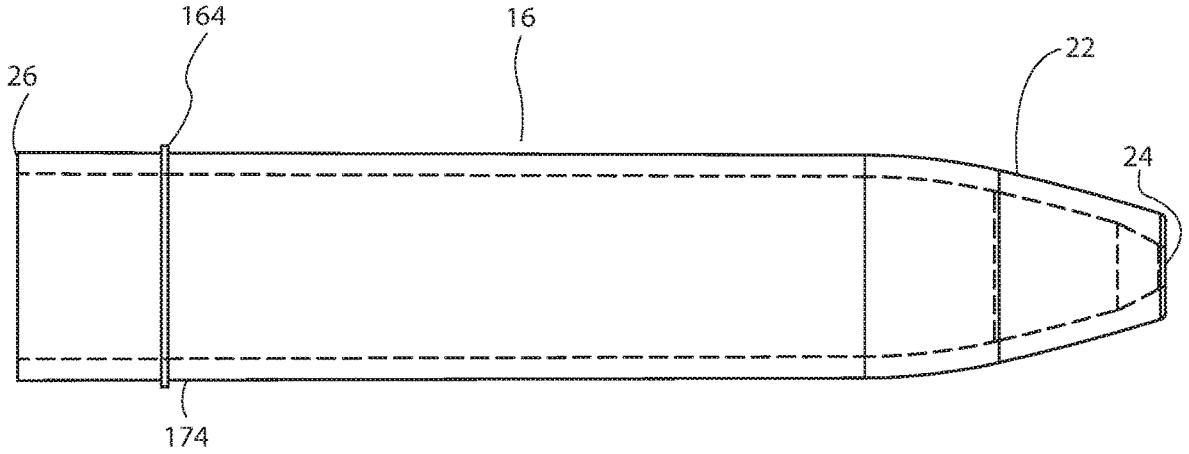
FIG. 13 is side view of the barrel of the multi-pencil of the present invention.
Figure 14:
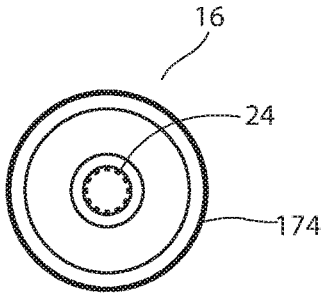
FIG. 14 is a left end view of the barrel of the multi-pencil of the present invention.
Figure 15:
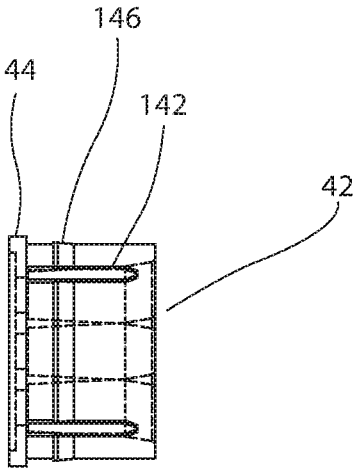
FIG. 15 is side view of the guide plug of the multi-pencil of the present invention.
Figure 16:
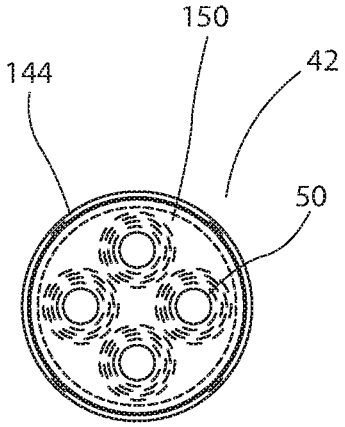
FIG. 16 is a top view of the guide plug of the multi-pencil of the present invention.
Figure 17:
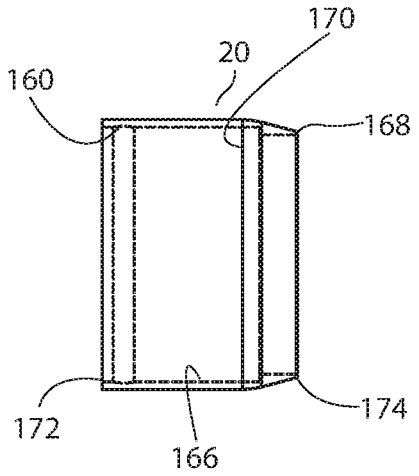
FIG. 17 is side view of the mid-body of the multi-pencil of the present invention.
Figure 18:
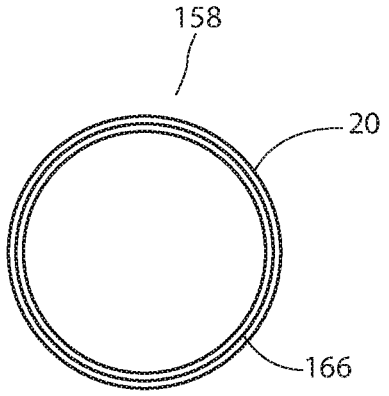
FIG. 18 is a bottom view of the mid-body of the multi-pencil of the present invention.
Figure 19:
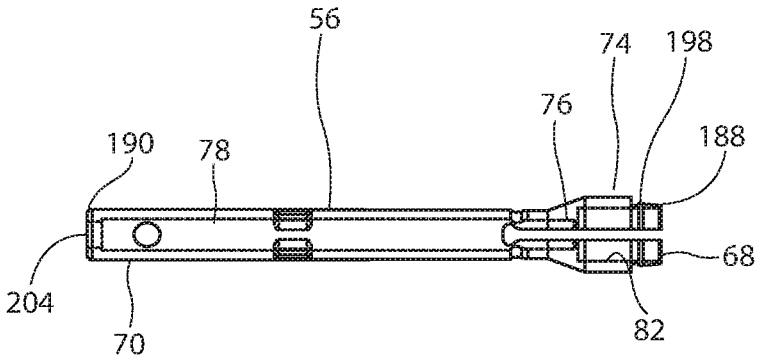
FIG. 19 is side view of the movable sleeve of the present invention.
Figure 20:
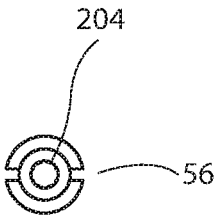
FIG. 20 is a front view of the movable sleeve of the multi-pencil of the present invention.

Referring now to FIGS. 10-12, a more detailed view of the main body 18 is shown. The main body includes the lower cylindrical portion 28 and the upper portion 30. The upper portion 30 includes four slots 44 spaced equidistant about the perimeter of the main body 18. Each slot 44 has a first end wall 130 and a second end wall 132. Located within each slot 44 is an upper pair of angled upper surfaces 128 and a pair of lower ledges 126 (see FIG. 12). The lower ledges 126 extend from side walls 134 of the slot 44 and which run in an axial direction partially along the length of the slot 44. The lower ledges 126 terminate forward of the second end wall 132 of the slot 44 at ledge end point 152. The upper angled surfaces 128 and lower ledges 126 form a guide channel 134.

With reference to FIG. 5, in an assembled and at rest state, the guides 116 of the slide members 46 are engaged within the guide channels 134. The slide member return springs 52 bias the slide members 46 axially rearward such that the catches 136 of the slide member 46 abut the end wall 130 of the slot 44 of the main body 18.

With reference to FIG. 4, when a slide member 46 is actuated, the finger tab 112 of a particular slide member, for example 46A, is pressed axially forward by a user such that such that the guide 116 slides out of the channel 134 at which point the user's finger pressure biases the finger tab 112 radially inwardly such that the catches 136 of the slide member 46A engage the end points 152 of the lower ledges 126 of the main body 18 and therein hold the slide member 46A in place in a depressed position during use of the cartridge assembly 12 connected to the slide member 46A.

To release the depressed slide member 46A, a user depresses another particular slide member 46B axially forward. Forward movement causes the striker 114 of the newly depressed slide member 46B to engage the rear angled surface 120 of the already depressed slide member 46A. Such engagement causes the catches 136 of the already depressed slide member 46A to be driven radially outwardly and off the end points 152 of the lower ledges 126 of the main body 18, thereby releasing the depressed slide member 46A. Once released, the depressed slide member 46A is returned to the at rest position by the slide member return spring 52. Upon the continued application of axially forward finger pressure, the slide member 46B continues to move forward until the guides 114 move out of the channel 134 and the catches 136 of the slide member 46B engage the end points 152 of the lower ledges 126.

In FIG. 4, particular slide member 46A and particular slide member 46B are oriented radially 180 degrees apart. In this orientation, striker 114 of slide member 46B engages the rear angled surface 120 of slide member 46A. However, particular slide members 46A and 46B may also be oriented radially at a 90 degree angle. In this case, if slide member 46A is depressed, subsequent depression of slide member 46B will cause the striker 114 of slide member 46B to contact one of the two mutually opposed angled side surfaces 122 (see FIGS. 7-9), which also has the effect of driving the depressed slide member 46A radially outwardly causing the catches 136 to disengage from the end points 152 of the lower ledges 126 and thereby release the slide member 46A.

Assembly of the Multi-Pencil of the Present Invention

The multi-pencil 10 of the present invention requires no mechanical fasteners or adhesives to assemble. Rather, the multi-pencil 10 may be assembled by means of snap fit components. With reference to FIGS. 5-14, to assemble the multi-pencil 10, the main body 18 is inverted and loaded from the open end with four of the slide assemblies 46, i.e. the guides 116 of each slide assembly 46 are engaged with one of the four channels 134 of the main body 18 and slid into the main body 18 until the catches 136 of the slide member 46 abut the second end wall 132. Next a slide member return spring 52 is placed about the operating rod 48 of each slide member 46.

Next protrusions 142 of the guide plug 42 are aligned with grooves 138 formed in the main body 18. The guide plug 42 is pressed into the main body 18 until an annular convex surface 146 of the guide plug 42 engages an annular concave surface 148 formed in the main body 18. Upon engagement of annular convex surface 146 with annular concave surface 148, annular rim 144 of the guide plug will rest within annular groove 140 of the main body 18. This completes the assembly of the components housed with the main body 18.

With reference to FIGS. 5-16, subsequently, a cartridge assembly 12 is attached to a ball end 154 of each of the operating rods 48 of the slide member 46. The ball ends 154 of the operating rods are configured to engage with the open upper ends 190 of the movable sleeve 56 of the cartridge assembly 12. Next, the barrel 16 is slid through a rear end 172 of the mid-body 20 and out a front end 168 of the mid-body 20. The barrel 16 is pressed or pulled through the mid-body 20 until an annular protrusion 164 of the barrel 16 is seated on an annular shelf 170 of the mid-body 20. The annular protrusion 164 of the barrel 16 is configured to be an interference fit with an inside diameter 166 of the mid-body 20. Next, a main body biasing spring 36 is slid over open upper end 26 of the barrel such that the main body biasing spring is retained between the outside diameter 174 of the barrel and the inside diameter 166 of the mid-body 20. Subsequently, the rear end 172 of the mid-body 20 is slid over a front end 180 of the main body 18. The mid-body 20 is pressed onto the main body 18 until an annular protrusion or concave surface 182 of the main body 18 engages an annular groove or convex surface 160 of the mid-body 20. This completes the assembly of the principle components of the multi-pencil 10.

Assembly of the Cartridge Assemblies

The cartridge assemblies 12 used in the multi-pencil 10 of the present invention are assembled as follows, with reference to FIGS. 1-4 and 17-23, the drawing material 14 is loaded into an open front end 94 of the hollow, cylindrical material holder 60. The serrated shaft 64 is partially inserted into an open rear end or second end 86 of the hollow, cylindrical material holder 60, the opening at the rear end being equipped with the serrated shaft engagement features 84, wherein the serrated shaft engagement features 84 are protrusions extending radially inwardly from the side wall of the material holder 60.

A biasing spring 62 is slid about the outside diameter 100 of the material holder 60 such that an end of the biasing spring 62 abuts the annular lip 66 (best shown in FIGS. 21-22) of the material holder 60. Subsequently, the rear end 86 of the material holder 60 is slid within the front end 188 of the movable sleeve 56 such that the biasing spring 62 abuts the front end 188 of the movable sleeve 56. Next, an open rear end 192 of a hollow, cylindrical spring retainer 58 is slid over the open front end 84 of the material holder 60 and is pressed forward until an annular concave surface or groove 196 of the spring retainer 58 engages an annular convex surface or ridge 198 of the movable sleeve 56 and therein snaps into place on the movable sleeve 56. In this position, the annular lip 66 of the material holder will rest upon an annular stop surface 200 of the spring retainer 58.

While the present invention has been described with regards to particular embodiments, it is recognized that additional variations of the present invention may be devised without departing from the inventive concept.

What is claimed is:

1. A multi-pencil, comprising:

a hollow, cylindrical main body having a closed upper end and an open lower end and a plurality of slots;

a hollow, cylindrical barrel having an open upper end and a tapered lower end, wherein the tapered lower end terminates in an aperture;

the main body and the barrel configured such that the upper end of the barrel is slideably received within the lower end of main body;

a plurality of cartridges movably retained within the barrel, each of the plurality of cartridges containing a drawing material and each cartridge configured to extrude the drawing material;

a plurality of cartridge selectors, each of the plurality of cartridge selectors connected to one of the plurality of cartridges, each of the plurality of cartridge selectors configured to slide within one of the plurality of slots in the main body, wherein each of the plurality of cartridge selectors is movable between a retracted position and a depressed position;

wherein each cartridge of the plurality of cartridges comprises a hollow, cylindrical sleeve having an upper end and a lower end, wherein the lower end includes a serrated shaft engagement feature; and, a hollow, cylindrical material holder having a first end and a second end, wherein the first end includes a serrated shaft engagement feature and draw(Cuing material, the first end of the material holder partially disposed within the lower end of the sleeve;

wherein an serrated shaft is partially disposed within the sleeve and is engaged with the serrated shaft engagement feature of the sleeve; and, wherein the serrated shaft is partially disposed within the material holder and engaged with the serrated shaft engagement feature of the material holder and abuts the drawing material, and;

wherein the serrated shaft engagement feature of the sleeve and the second serrated shaft engagement feature of the material holder allow the serrated shaft to move axially in a downwards direction only;

wherein, when one arbitrary cartridge selector out of the plurality of cartridge selectors is in the retracted position, the connected cartridge is retained inside the barrel and when the arbitrary cartridge selector is moved to the depressed position, the second end of the material holder of the connected cartridge protrudes from the aperture in the tapered lower end of the barrel;

wherein, when the arbitrary cartridge selector is in the depressed position and the second end of the material holder of the connected cartridge protrudes from the aperture of the barrel, axial downwards movement of the main body causes the cartridge selector to move the sleeve of the connected cartridge downwardly causing the serrated shaft to move downwardly past the serrated shaft engagement feature of the material holder, thereby dispensing the drawing material from the material holder.

2. The multi-pencil of claim 1, wherein the barrel and main body are interconnected by a mid-body, wherein the mid-body is configured with a biasing spring which biases the main body axially away from the barrel.

3. The multi-pencil of claim 1, wherein the sleeve and the material holder are interconnected by spring retainer wherein the spring retainer is configured with a biasing spring that biases the sleeve axially away from the material holder.

4. The multi-pencil of claim 1, wherein the connection between the at least one cartridge selector and the at least one cartridge is configured to allow the at least one cartridge to deflect radially inwardly.

5. The multi-pencil of claim 1, wherein the cartridge selector includes a ball end surrounded by flexible fingers which engages a socket in the sleeve of the cartridge assembly, which allows the cartridge assembly to move angularly with respect to the cartridge selector.

6. The multi-pencil of claim 1, further including a guide within the upper body wherein the guide includes a plurality of holes, each hole corresponding to one of the plurality of cartridge selectors, wherein the guide positions the plurality of cartridge selectors about the inside perimeter of the upper body.

7. A multi-pencil, comprising:

a main body having an open lower end and at least one slot;

a leading body having an open upper end and a lower end terminating in an aperture;

the main body and the leading body configured such that leading body is partially disposed and slideably received within the main body;

at least one cartridge having a first end and a second end, movably retained within the leading body, the at least one cartridge containing a drawing material dispensable from the second end of the cartridge;

at least one cartridge selector connected to the at least one cartridge and configured to slide within the at least one slot in the main body between a retracted position and a depressed position;

wherein the at least one cartridge comprises a sleeve containing a serrated shaft engagement feature, a material holder containing a serrated shaft engagement feature and drawing material, the material holder partially disposed within the sleeve;

wherein, a serrated shaft is partially disposed within the material holder and engaged with the serrated shaft engagement feature of the material holder and abuts the drawing material, and wherein the serrated shaft is partially disposed within the sleeve and is engaged with the serrated shaft engagement feature of the sleeve;

wherein the serrated shaft engagement feature of the sleeve and the serrated shaft engagement feature of the material holder allow the serrated shaft to move in a downwards direction only;

wherein, when the at least one cartridge selector is in the retracted position, the at least one cartridge is retained within the leading body and, when the at least one cartridge selector is moved to the depressed position, the second end of the material holder protrudes from the aperture in the leading body;

wherein, when the at least one cartridge selector is in the depressed position, movement of the main body towards the leading body causes the at least one cartridge selector to move the sleeve forward causing the serrated shaft to move past the serrated shaft engagement feature of the material holder, thereby advancing the drawing material downwardly from within the material holder.

8. The multi-pencil of claim 7, wherein the leading body has a cylindrical upper portion and a tapered lower portion terminating in the exit aperture.

9. The multi-pencil of claim 7, wherein the connection between the at least one cartridge selector and the at least one cartridge is configured to allow the at least one cartridge to deflect radially inwardly.

10. The multi-pencil of claim 7, wherein the cartridge selector includes a ball end surrounded by flexible fingers which engages a socket in the sleeve of the cartridge assembly, which allows the cartridge assembly to move angularly with respect to the cartridge selector.

11. The multi-pencil of claim 7, wherein the barrel and leading body are interconnected by a mid-body, wherein the mid-body is configured with a biasing spring which biases the main body axially away from the leading body.

12. The multi-pencil of claim 7, wherein the sleeve and the material holder are interconnected by spring retainer wherein the spring retainer is configured with a biasing spring that biases the sleeve axially away from the material holder.

13. A multi-pencil, comprising:

a main body having at least one slot;

a leading body having a lower end terminating in an aperture;

the main body and the leading body configured such that leading body is partially disposed and slideably received within the main body;

at least one cartridge movably retained within the leading body, the at least one cartridge containing a drawing material dispensable from an open end of the cartridge;

at least one cartridge selector connected to the at least one cartridge and configured to slide within the at least one slot in the main body between a retracted position and a depressed position;

wherein, when the at least one cartridge selector is in the retracted position, the at least one cartridge is retained inside the leading body and when the at least one cartridge selector is moved to the depressed position, the at least one cartridge moves such that the open end of the cartridge protrudes from the aperture in the leading body;

wherein, when the at least one cartridge selector is in the depressed position and the first end of the at least one cartridge protrudes from the aperture of the leading body, movement of the main body towards the leading body causes the cartridge to extrude drawing material; and wherein the barrel and leading body are interconnected by a mid-body, wherein the mid-body is configured with a biasing spring which biases the main body axially away from the leading body.

14. The multi-pencil of claim 13, wherein the at least one cartridge comprises a sleeve containing a serrated shaft engagement feature, a material holder containing a serrated shaft engagement feature and drawing material, the material holder partially disposed within the sleeve; and, wherein an serrated shaft is partially disposed within the material holder and engaged with the serrated shaft engagement feature of the material holder and abutting the drawing material; and, wherein the serrated shaft is partially disposed within the sleeve and engaged with the serrated shaft engagement feature of the sleeve; and, wherein the serrated shaft engagement feature of the sleeve and the serrated shaft engagement feature of the material holder allow the serrated shaft to move in a downward direction only.

15. The multi-pencil of claim 13, wherein the leading body has a cylindrical upper portion and a tapered lower portion terminating in the exit aperture.

16. The multi-pencil of claim 13, wherein the connection between the at least one cartridge selector and the at least one cartridge is configured to allow the at least one cartridge to deflect radially inwardly.

17. The multi-pencil of claim 13, wherein the cartridge selector includes a ball end surrounded by flexible fingers which engages a socket in the sleeve of the cartridge assembly, which allows the cartridge assembly to move angularly with respect to the cartridge selector.

18. The multi-pencil of claim 14, wherein the sleeve and the material holder are interconnected by a spring retainer wherein the spring retainer is configured with a biasing spring that biases the sleeve axially away from the material holder.

19. The multi-pencil of claim 13, further including a guide within the upper body wherein the guide includes at least one hole for controlling the location of one cartridge selector within the upper body.

* * * * *